US007288743B1

(12) United States Patent
Kim et al.

(10) Patent No.: US 7,288,743 B1
(45) Date of Patent: Oct. 30, 2007

(54) CONVECTION OVEN

(75) Inventors: Seo-Young Kim, Seoul (KR); Tae-Ho Ji, Busan (KR)

(73) Assignee: Korea Institute of Science and Technology (KR)

( * ) Notice: Subject to any disclaimer, the term of this patent is extended or adjusted under 35 U.S.C. 154(b) by 0 days.

(21) Appl. No.: 11/533,511

(22) Filed: Sep. 20, 2006

(30) Foreign Application Priority Data

Feb. 8, 2006 (KR) ..... 10-2006-0012243

(51) Int. Cl.
*A21B 1/00* (2006.01)

(52) U.S. Cl. ..... 219/400; 219/391; 392/347

(58) Field of Classification Search ..... None
See application file for complete search history.

(56) References Cited

U.S. PATENT DOCUMENTS 3,889,100 A * 6/1975 Dills ..... 219/393
7,066,398 B2 * 6/2006 Borland et al. ..... 239/102.2
2005/0229675 A1 * 10/2005 Haupt et al. ..... 73/23.2

FOREIGN PATENT DOCUMENTS

KR 1020010008752 A 2/2001

* cited by examiner

*Primary Examiner*—Thor S. Campbell
(74) *Attorney, Agent, or Firm*—Ostrolenk, Faber, Gerb & Soffen, LLP

(57) ABSTRACT

A convection oven includes an oven body having a heating chamber heated by a heat source, and a vibration unit mounted at one side of the oven body and vibrating heated air so as to be uniformly distributed within the heating chamber. As the vibration unit vibrates, air within the heating chamber can be fluctuated periodically to promote mixing between more heated air and less heated air to make temperature of air uniform. Accordingly, heat can be uniformly distributed to a cooking target or material, quality of cooking can be improved, and in addition, because cooking time can be shortened, the performance of the oven can be enhanced.

7 Claims, 3 Drawing Sheets

CONVECTION OVEN

RELATED APPLICATION

The present disclosure relates to subject matter contained in priority Korean Application No. 10-2006-12243, filed on Feb. 8, 2006, which is herein expressly incorporated by reference in its entirety.

BACKGROUND OF THE INVENTION

1. Field of the Invention

The present invention relates to a convection oven and, more particularly, to a convection oven capable of improving performance of cooking food items or heat treatment performance of materials and shortening a heating time by removing a phenomenon that an internal temperature of a heating chamber is not uniform.

2. Description of the Related Art

In general, an oven is a device for applying heat to a material placed in a closed heating chamber. In case of a home oven, the oven is commonly used as a cooking device for heating food items and in case of an industrial oven, the oven is used to heat or melt various materials or test samples at a certain temperature.

One of important criteria for evaluating performance of the oven is heat distribution capability over a heating target, namely, a food item or a material. This is because how successfully a food item is cooked or a material is thermally processed can be determined according to how uniformly heat is distributed. For example, if heat is inclined to a location within the oven while a food item is being cooked, the food item would be burned or less cooked and a cooking time would be lengthened as much.

Within the heating chamber, hot air can be mixed with naturally generated convection flow, but the degree is too small to obtain a sufficient effect. Thus, in order to increase a heat spreading speed and obtain uniform temperature distribution in the oven, various techniques have been developed.

One of the typical techniques is an installation of a fan within the oven to forcibly circulate internal air of the oven to cause convection. However, convection generated by the fan may contribute to distribute heat, but not enough and hot air flowing is still partially concentrated (not uniform), causing a phenomenon that temperatures at locations are high or low within the oven.

BRIEF DESCRIPTION OF THE INVENTION

Therefore, an object of the present invention is to provide a convection oven capable of improving heating performance and shortening a heating time by making hot air uniform within a heating chamber.

To achieve these and other advantages and in accordance with the purpose of the present invention, as embodied and broadly described herein, there is provided a convection oven including: an oven body having a heating chamber heated by a heat source; and a vibration unit mounted at one side of the oven body and vibrating heated air so as to be uniformly distributed within the heating chamber.

Herein, a plurality of air holes may be formed at the side of the oven body to allow heated air within the heating chamber to flow in and out therethrough according to vibration of the vibration unit.

The vibration unit may include a vibration plate installed to face the heating chamber and generating waves of heated air and an actuator for driving the vibration plate.

A cover may be provided at the vibration unit to cover the periphery of the vibration plate so that when the vibration plate vibrates, an air flow that passes through the air holes disposed at the inner side of the vibration plate and an air flow that passes through the air holes disposed at the outer side of the vibration plate can be opposed to each other.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

A convection oven according to the present invention will now be described with reference to the accompanying drawings.

Figure 1:
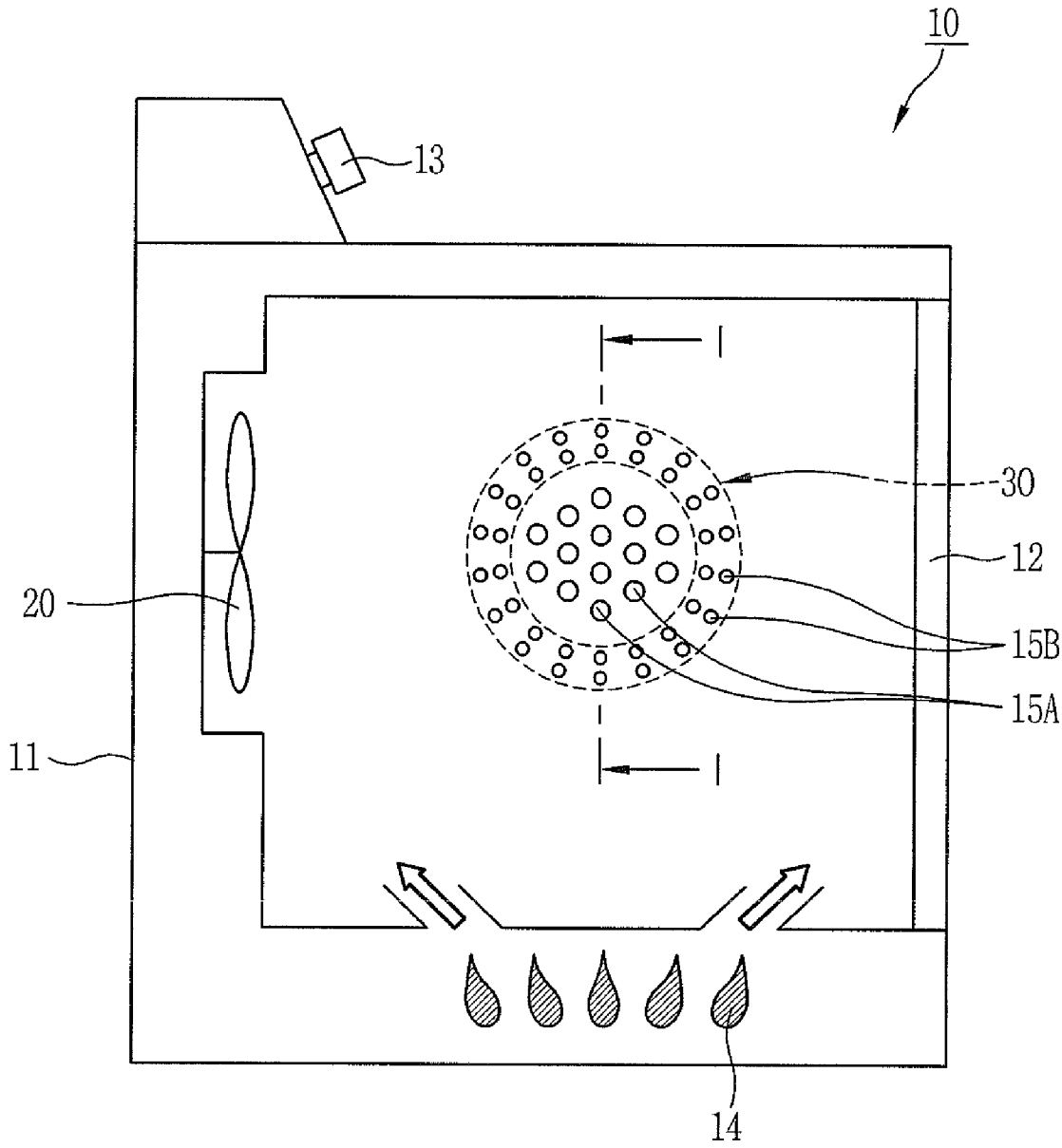
FIG. 1 is a side sectional view of a convection oven according to an exemplary embodiment of the present invention.

FIG. 1 is a side sectional view of a convection oven according to an exemplary embodiment of the present invention.

As shown in FIG. 1, a convection oven 10 includes a heating chamber 11*a* heated by a heat source 14 and an oven body 11 where a door 12 is installed.

The heat source 14 may be a gas burner as shown in FIG. 1 but it can be also an electric heater.

A control switch 13 for controlling the convection oven 10 can be provided at an upper portion of the oven body 11.

A fan 20 is can be installed at a rear surface of the oven body 11 in order to forcibly circulate air sent after being heated by the heat source 14. Accordingly, air within the heating chamber 11*a* can be mixed faster according to a rotation of the fan 20 than by the convection current that is naturally generated.

A plurality of air holes 15A and 15B are formed at the side of the oven body 11, and a vibration unit 30 is installed at the opposite side of the air holes 15A and 15B in order to vibrate heated air so as to be evenly distributed through the air holes 15A and 15B.

Figure 2:
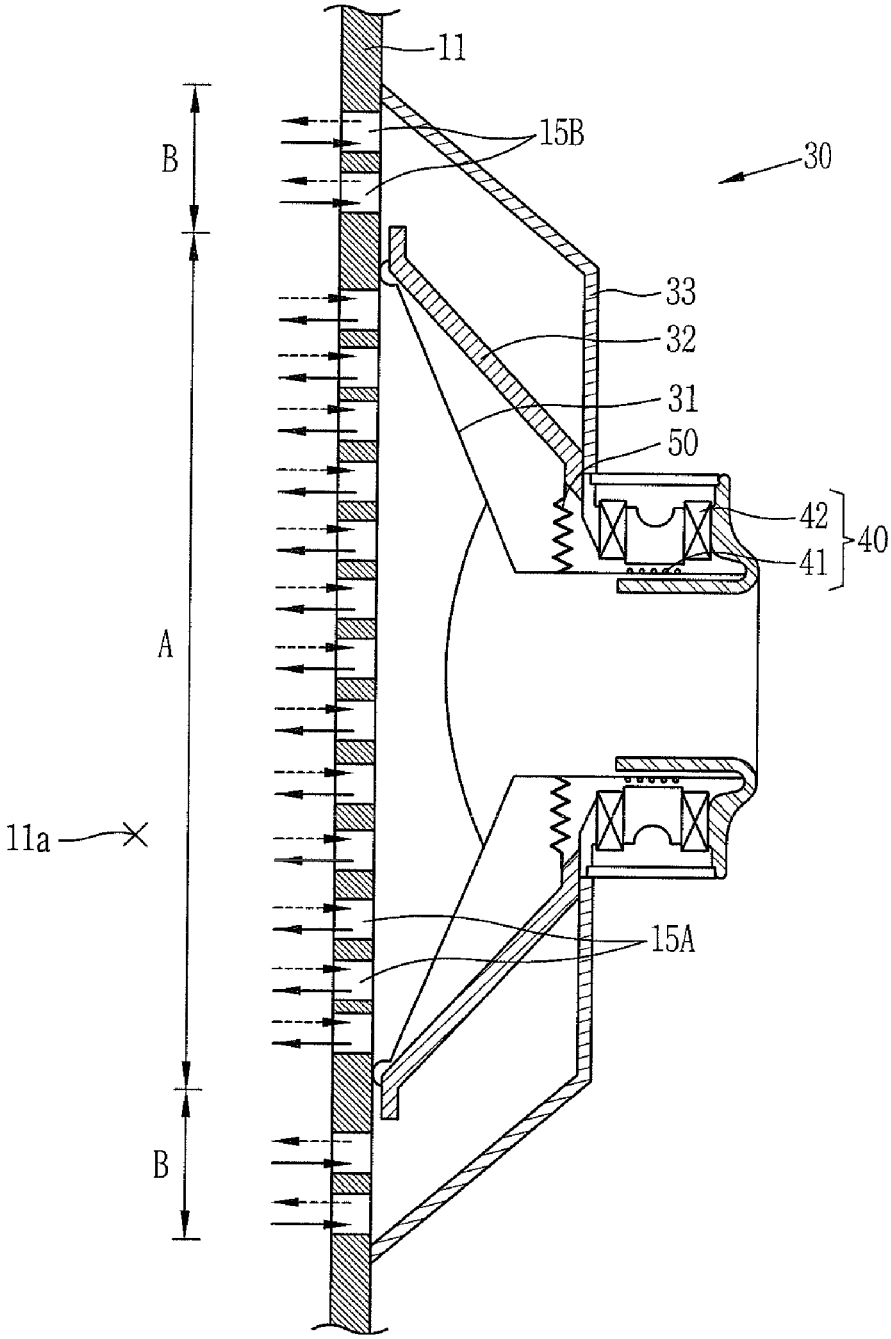
FIG. 2 is a sectional view taken along line I-I in FIG. 1.

FIG. 2 is a sectional view taken along line I-I in FIG. 1. As shown in FIG. 2, the vibration unit 30 includes a vibration plate 31 installed toward the heating chamber 11*a* and generating waves to the heated air, an actuator 40 for actuating the vibration plate 31 forward and backward, and a frame 32 for supporting the actuator 40 at the oven body 11.

The actuator 40 includes a voice coil 41 fixed at a tail of the vibration plate 31 and a fixed magnet 42 installed to be separated from the voice coil 41 at a certain distance and applying magnetic force to the voice coil 41. Herein, as the fixed magnet 42, the electromagnetic magnetic as shown can be used, and a permanent magnet can be also adopted.

In addition, an eccentric motor can be used to achieve the same effect as that of the actuator 40.

The air holes 15A and 15B refer to air holes 15A formed at a first interval (A), a region which corresponds to the vibration plate 31, and air holes 15B formed at a second interval (B) coming between an outer circumference of the vibration plate 31 and a cover 33.

Preferably, the vibration plate 31 has a corn shape and can be tightly attached to the oven body 11 to cover the air holes 15A of the first interval (A). It is recommended that the vibration plate 31 is made of a material with appropriate heat resistance to have stable response characteristics in a high temperature usage environment and high frequency.

A damper 50 for absorbing an impact that may be transferred to the oven body 11 when the vibration plate 31 vibrates can be mounted at a rear end portion of the vibration plate 31.

The cover 33 is provided around the vibration plate 31 so that when the vibration plate 31 vibrates, an air flow through the air holes 15A formed at the first interval (A) belonging to the inner side of the vibration plate 31 and an air flow through the air holes 15B formed at the second interval (B) belonging to the outer side of the vibration plate 31 can be opposed to each other.

Herein, air flows are being opposed to each other means, for example, when air passes from the heating chamber 11*a* and is discharged through the air holes 15A to the vibration plate 31 (At this time, the vibration plate 31 retreats toward the actuator 30), air present between the cover 33 and the vibration plate 31 passes through the air holes 15B of the second interval (B) and then introduced into the heating chamber 11*a* (arrows indicated by a dotted line indicate such air flows). In addition, arrows indicated by a solid line indicate the air flows when the vibration plate 31 is moved in the opposite direction.

Accordingly, when the vibration plate 31 vibrates forward and backward, air passes through the air holes 15A of the first interval (A) and the air holes (B) of the second interval (B) in the mutually opposite directions to generate air streams split minutely within the heating chamber 11*a*, whereby air flows are mixed with each other to its maximum level within the heating chamber.

In other words, the hot air within the heating chamber 11*a* is first forcibly mixed according to the rotation of the fan 20, and in addition, as the vibration plate 31 vibrates, the flow of the hot air is uniformly distributed. Accordingly, deviation of temperature of the air at various locations within the heating chamber 11*a* can be reduced.

Figure 3:
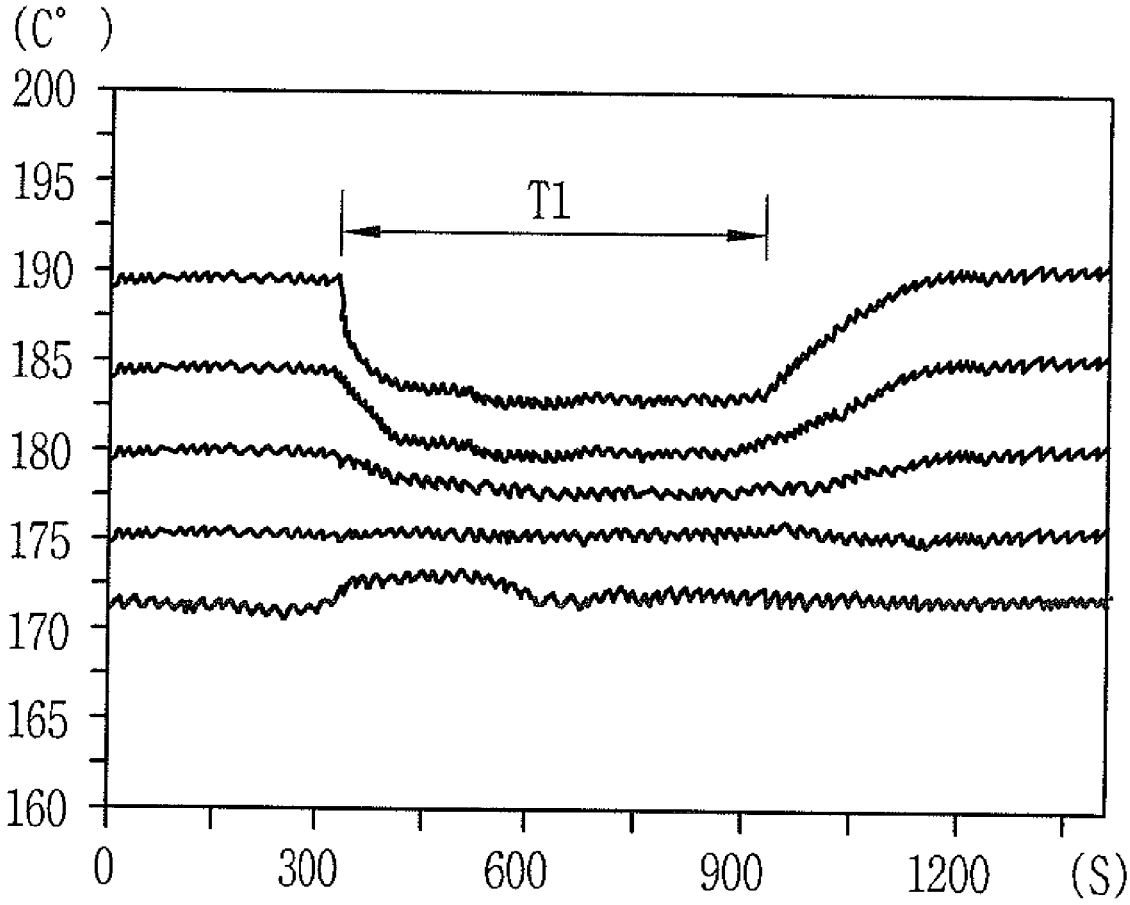
FIG. 3 is a graph showing that deviation of temperature within a heating chamber is reduced as a vibration unit is operated.

This effect is shown in FIG. 3. FIG. 3 is a graph showing that deviation of temperature within the heating chamber 11*a* is reduced as the vibration unit 30 is operated.

It is noted that the deviation of temperatures of five locations within the heating chamber is remarkably reduced at the time interval (T1) during which the vibration unit 30 is operated.

Namely, the temperature deviation between a maximum value and a minimum value was observed to be about 18° C. before the vibration unit 30 was operated, which was reduced to about 10° C. after the vibration 30 was operated.

This means that because heat is evenly distributed to a material, a cooking time or heat treatment time is shortened.

As described above, the convection oven according to the present invention has many advantages.

That is, for example, because the vibration unit vibrates, air within the heating chamber can be fluctuated periodically to promote mixing between more heated air and less heated air to make temperature of air uniform. Accordingly, heat can be uniformly distributed to a cooking target or material, quality of cooking can be improved, and in addition, because cooking time can be shortened, the performance of the oven can be enhanced.

In addition, air within the heating chamber is flows into or out of the heating chamber through different air holes according to vibration of the vibration unit, the hot air can be more quickly mixed.

Moreover, because the cover is provided to cover the vibration unit, the air within the heating chamber can be fluctuated without an air loss.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A convection oven comprising:

an oven body having a heating chamber heated by a heat source; and a vibration unit mounted at one side of the oven body and vibrating heated air so as to be uniformly distributed within the heating chamber.

2. The oven of claim 1, wherein a plurality of air holes are formed at the side of the oven body to allow heated air within the heating chamber to flow in and out therethrough according to vibration of the vibration unit.

3. The oven of claim 1, wherein the vibration unit comprises:

a vibration plate installed to face the heating chamber and generating waves of heated air; and an actuator for driving the vibration plate.

4. The oven of claim 3, wherein the actuator comprises:

a voice coil fixed at the vibration plate; and a fixed magnet installed to be separated from the voice coil at a certain distance and applying a magnetic force to the voice coil.

5. The oven of claim 3, wherein the vibration plate has a corn shape.

6. The oven of claim 3, wherein the vibration unit further comprises a cover for covering the periphery of the vibration plate so that when the vibration plate vibrates, an air flow that passes through the air holes disposed at the inner side of the vibration plate and an air flow that passes through the air holes disposed at the outer side of the vibration plate are opposed to each other.

7. The oven of claim 3, wherein the oven body further comprises a fan for forcibly convect heated air.

* * * * *